US006808214B2

(12) United States Patent
Sato et al.

(10) Patent No.: US 6,808,214 B2
(45) Date of Patent: Oct. 26, 2004

(54) LOCKING APPARATUS AND STORAGE APPARATUS FOR VEHICLE

(75) Inventors: Tomoaki Sato, Hachioji (JP); Yasuo Yamamoto, Utsunomiya (JP)

(73) Assignee: NIFICO Inc., Yokohama (JP)

( * ) Notice: Subject to any disclaimer, the term of this patent is extended or adjusted under 35 U.S.C. 154(b) by 0 days.

(21) Appl. No.: 10/050,874

(22) Filed: Jan. 18, 2002

(65) Prior Publication Data

US 2002/0096892 A1 Jul. 25, 2002

(30) Foreign Application Priority Data

Jan. 19, 2001 (JP) ..... 2001-012481

(51) Int. Cl.[7] ..... E05B 15/02

(52) U.S. Cl. ..... 292/341.15; 292/341.17; 292/DIG. 22; 296/37.12

(58) Field of Search ..... 292/341.15, DIG. 22, 292/341.17, DIG. 4; 296/37.12, 37.8

(56) References Cited

U.S. PATENT DOCUMENTS 2,817,554 A * 12/1957 Hasselmark ..... 292/340
3,854,784 A * 12/1974 Hunt et al. ..... 312/9.63
4,552,399 A * 11/1985 Atarashi ..... 296/37.12
5,052,728 A * 10/1991 Fukumoto ..... 292/106
5,460,309 A * 10/1995 Nehl et al. ..... 224/281
5,845,954 A * 12/1998 DePue ..... 296/37.12
6,241,300 B1 * 6/2001 Suzuki ..... 296/37.8
6,247,733 B1 * 6/2001 Weiland ..... 292/228

FOREIGN PATENT DOCUMENTS

| | | |
|---|---|---|
| DE | 44 27 768 | 11/1995 |
| EP | 0 561 332 | 9/1993 |
| GB | 2 335 416 | 6/1999 |
| JP | 7-266996 | 10/1995 |

* cited by examiner

*Primary Examiner*—John B. Walsh
(74) *Attorney, Agent, or Firm*—Manabu Kanesaka

(57) ABSTRACT

A locking apparatus locks a moving body to a housing against an urging force applied to the moving body. The locking apparatus includes a cam provided on one of the moving body and the housing, and having an engagement groove and a releasing groove, and a swivel body provided on the other of the moving body and the housing. The swivel body has a trace pin moving along the grooves and a balancer for balancing the trace pin. Thus, upon receiving a sudden load when the trace pin is in an engaging condition with the engagement groove, the trace pin is prevented from moving from the engagement groove to the releasing groove to thereby lock the moving body.

6 Claims, 9 Drawing Sheets

LOCKING APPARATUS AND STORAGE APPARATUS FOR VEHICLE

BACKGROUND OF THE INVENTION AND RELATED ART STATEMENT

The present invention relates to a locking apparatus, in particular a locking apparatus with safety function, the subject of which is a so-called push—push engagement mechanism that engages a moving body by a push operation and releases the engagement by a subsequent push operation, as well as a storage apparatus for vehicle.

Among locking apparatuses that comprise push—push engagement mechanisms, there is one that is constituted by a cam part with heart-shaped cam groove provided on one of a moving body and a housing, and a swivel body that is provided on the other side and has a trace pin that moves on the inside of the cam groove. FIGS. 10(*a*)–10(*c*) show one of the conventional structures. In this example, a moving body in a housing, i.e. a storage tray, is moved against the force of forcing means toward the direction of symbol C to close an opening of the housing, and is moved toward the direction of symbol O by that force to become in the open state. The swivel body 100 having a leaf-shaped arm is attached to the housing inside the vehicle compartment so as to be able to move via a pivot 103, and it has a trace pin 102 on the tip. The cam part 104 is provided on the moving body, and it has a raised cam part 105 whose periphery forms a heart-shaped cam groove 106, and a guide groove 107.

The engagement operation of the push—push engagement mechanism is as follows. FIG. 10(*a*) shows the engagement released state, where the moving body has moved in the direction of arrow O by the forcing means, and it is pulled out from the housing. In this open state, when the moving body is pushed back into the housing against the force of the forcing means toward the direction of arrow C in FIG. 10(*a*), the trace pin 102 first meets the engagement guide cam surface 107*a* of the guide groove 107, and the swivel body 100 rotates counter-clockwise. Upon further movement, after contacting the engagement guide cam groove 106*a* of the cam groove 106, the trace pin 102 collides with the stopper cam surface 104*a* at the front of the cam part. The moving body is pushed in up to that collision. When the pushing force is released, the moving body is pushed back by the force of the forcing means, and the trace pin 102 engages the engagement groove 106*b* of the cam groove 106 as in FIG. 10(*b*). The moving body is stopped by that engagement (that is, the push engagement operation is completed), and it is held in the housing.

In the next operation of the mechanism, when the moving body is pushed toward the direction of arrow C1 in FIG. 10(*b*), the trace pin 102 meets the stopper surface guide cam surface 104*b* at the front of the cam part, and is led from that guide cam surface 104*b* up to the neighboring stopper cam surface 104*c* accompanying the rotation of the swivel body 100. When the pushing force is released, the moving body is pushed toward the direction of arrow C in FIG. 10(*a*) by the force of the forcing means. As a result, the trace pin 102 returns from the stopper cam surface 104*c* to the original position through the contact of the cam groove 106, the guide cam groove 106*c*, the guide cam surface 107*b* on the side of the guide groove 17 along the way, and becomes in the open state.

From the fact that the above push—push engagement mechanism is constituted by the swivel body 100 with the trace pin 102 and the cam part 104, as opposed to the type published in Japanese Utility Model publication No. H5-91964, in which a pair of engagement pieces engages and releases a tab of the other member, it is simpler as it does not require a dedicated spring member. Additionally, it is superior in terms of operating quality in that there is less noise when engaging and releasing. However, with this structure in FIG. 10(*b*) in which the moving body is engaged, when an abrupt load (this load is an unanticipated load that would make a small movement of the moving body toward the direction opposite to the force pressure of the forcing means and roll the swivel body 100) is applied, i.e. by a sudden stop or collision while driving, a condition identical to the push release operation can occur. If this happens, the trace pin 102 meets the guide cam surface 104*b*, and it easily moves from the stopper cam surface 104*c* to the releasing guide cam groove 106*c* of the cam groove 106 and the releasing guide cam surface 107*b* of the guide groove 17. It may cause an unanticipated and sudden engagement release.

These erroneous operations damage the performance and quality of the product. As countermeasures, for example, the shape of the engagement groove 106*b* is modified such that the groove is firmly engaged with the trace pin 102, or a setting the force pressure of the forcing means is adjusted. Nonetheless, the operating performance tends to be sacrificed, and it is still unsatisfactory. In the prior art, as in Japanese Patent Publication No. H7-266996, albeit using a different engagement mechanism, there is also known a structure that prevents in advance the occurrence of the unanticipated engagement release as above. However, the structure requires a spring member which forces the cam member on which the cam groove is formed to swivel one-way by the spring member. The larger number of parts is needed and it becomes more complicated. It is not also widely applicable as the force pressure setting of the spring member would be necessary for each product.

The object of the present invention is to solve the problems such as above. Specifically, it is an object of the invention to provide a push—push engagement mechanism formed of a heart-shaped cam part and a swivel body, wherein the occurrence of unanticipated engagement release of the push—push engagement mechanism can be prevented by a simple and widely usable structure.

Another object of the invention is to provide the push—push engagement mechanism as stated above, wherein an improvement of the reliability of the locking apparatus can be achieved, and it will be able to further expand the uses of the locking apparatus to other kinds of storage apparatuses.

Further objects and advantages of the invention will be apparent from the following description of the invention.

SUMMARY OF THE INVENTION

In order to achieve the above-mentioned objects, a locking apparatus has a push—push engagement mechanism and comprises a cam part with a heart-shaped cam groove provided on one of a moving body and a housing, and a swivel body provided on the other of the moving body and the housing and having a trace pin that moves on the cam groove, wherein the moving body is engaged with the housing at a fixed position by an operation of pushing the moving body opposite to the force of forcing means, and the engagement can be released by a subsequent push operation. Furthermore, the swivel body has a balancer that detects the load when an unanticipated load such as impact is received while in the engaged state, so as to make it possible to prevent the trace pin from moving from an engagement groove of the cam groove to a releasing guide cam groove.

In the present invention, "when an unanticipated load such as impact is received" means that when a vehicle is suddenly stopped while driving, a collision occurs, or excessive vibration is directly or indirectly received. In such cases, the moving body is slightly moved toward the direction opposite to the force of the forcing means and the swivel body moved. "Detects the load" means that the swivel body receives the load and automatically or by itself tries to allow the trace pin to move from the engagement groove of the cam groove to the releasing guide cam groove. "Cam part with a heart-shaped cam groove" means a type at least having a cam groove that is heart-shaped in the periphery of a raised cam part as the construction of the cam part.

The above structural characteristic is that, when the unanticipated load is received, the trace pin and the engagement groove shift positions relatively so as to release the engagement, but that shift of positions is corrected by the balance adjusting operation of the balancer of the swivel body, and the trace pin and the engagement groove are automatically moved toward engagement again, such that the releasing engagement is prevented. Accordingly, the storage apparatus for the vehicle according to this invention is particularly suitable for automobiles, trains, ships, airplanes, and so on, which tend to receive the sudden loads noted above, and the erroneous operation can be eliminated. Also, the manufacturing cost can be minimized, and the product operation, quality and safety can be improved.

In the first aspect of the invention, the swivel body comprises an attachment part for pivot that is attached on the side of the housing or moving body to be capable of swinging, a first arm, and a second arm. The first arm is connected to the attachment part from which the trace pin projects, and the second arm is connected to the attachment part at an angle of at least 90 degrees to the first arm to form the balancer. This materializes the present invention from the shape of the swivel body. Because this second arm is disposed at an angle of at least 90 degrees to the first arm in the engaged state, it is the optimal mode for controlling the direction of swinging of the swivel body and making it move (balance adjusting) exclusively not to disengage from the groove.

In the second aspect of the invention, the balancer comprises a spindle or weight that works in cooperation with the trace pin and the force of the forcing or urging means so as to return the swivel body which swings due to the load to the engagement groove. This spindle controls the rotational direction of the swivel body to the side of the engagement stopper cam surface. The urging means moves the moving body toward the direction of the engagement groove. The trace pin is moved by the movement of the moving body to the engagement groove and comes to the engaged state. The present invention utilizes this series of movements.

In the third aspect of the invention, the swivel body is a molded resin product, and the second arm has a metal member for the spindle on at least one part thereof. This is a superior structure in terms of producing a smaller weight for the spindle, because the swivel body in the present invention is used for balance adjustment operation. There may be a construction such that a metal member is inserted in the balancer, and the second arm itself is constituted by a metal member, and the like, and either is applicable to the present invention.

DETAILED DESCRIPTION OF PREFERRED EMBODIMENTS

Hereunder, embodiments of the invention will be explained with reference to the accompanied drawings.

Figure 1:
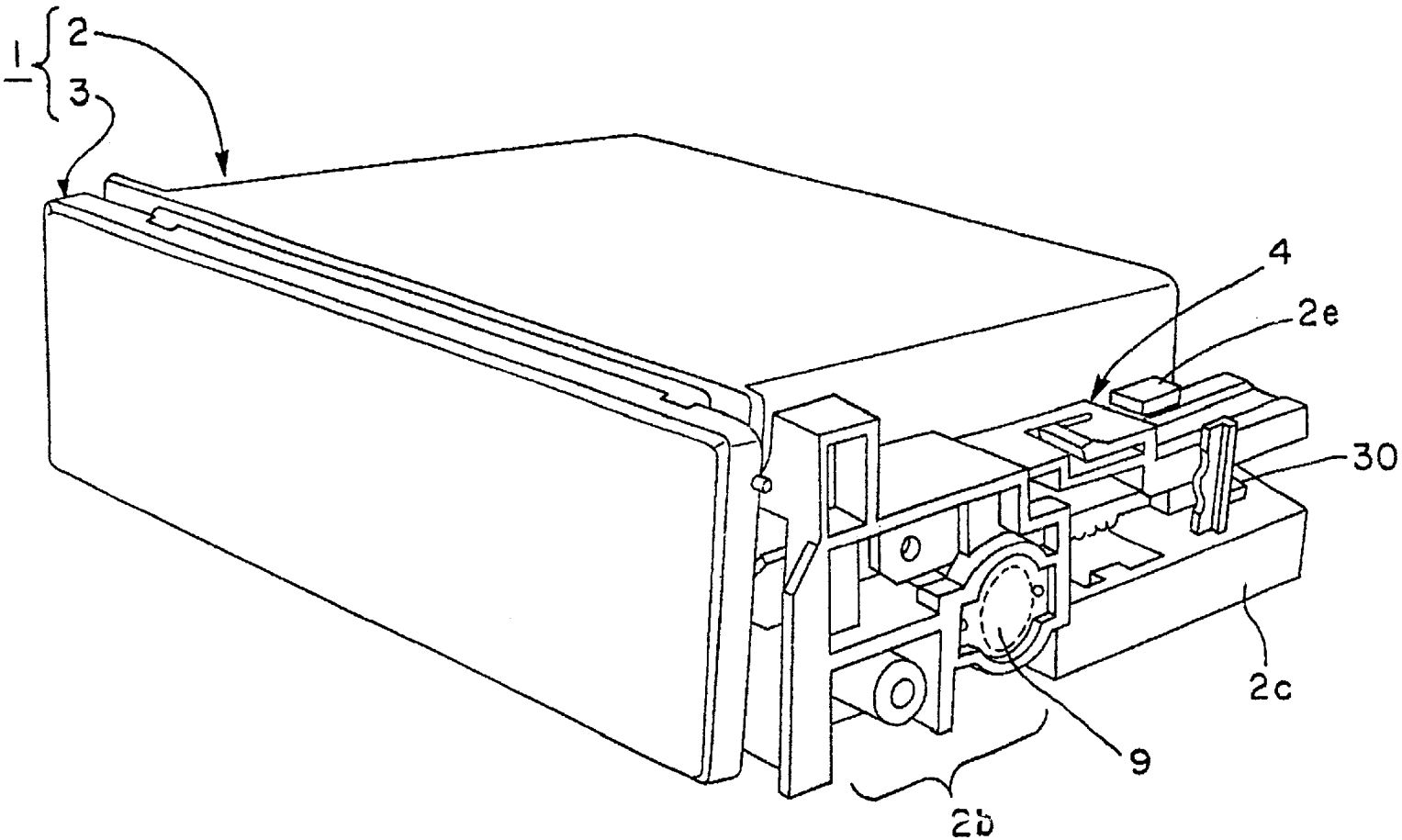
FIG. 1 is a generalized external view of the storage apparatus in the present invention.
Figure 2:
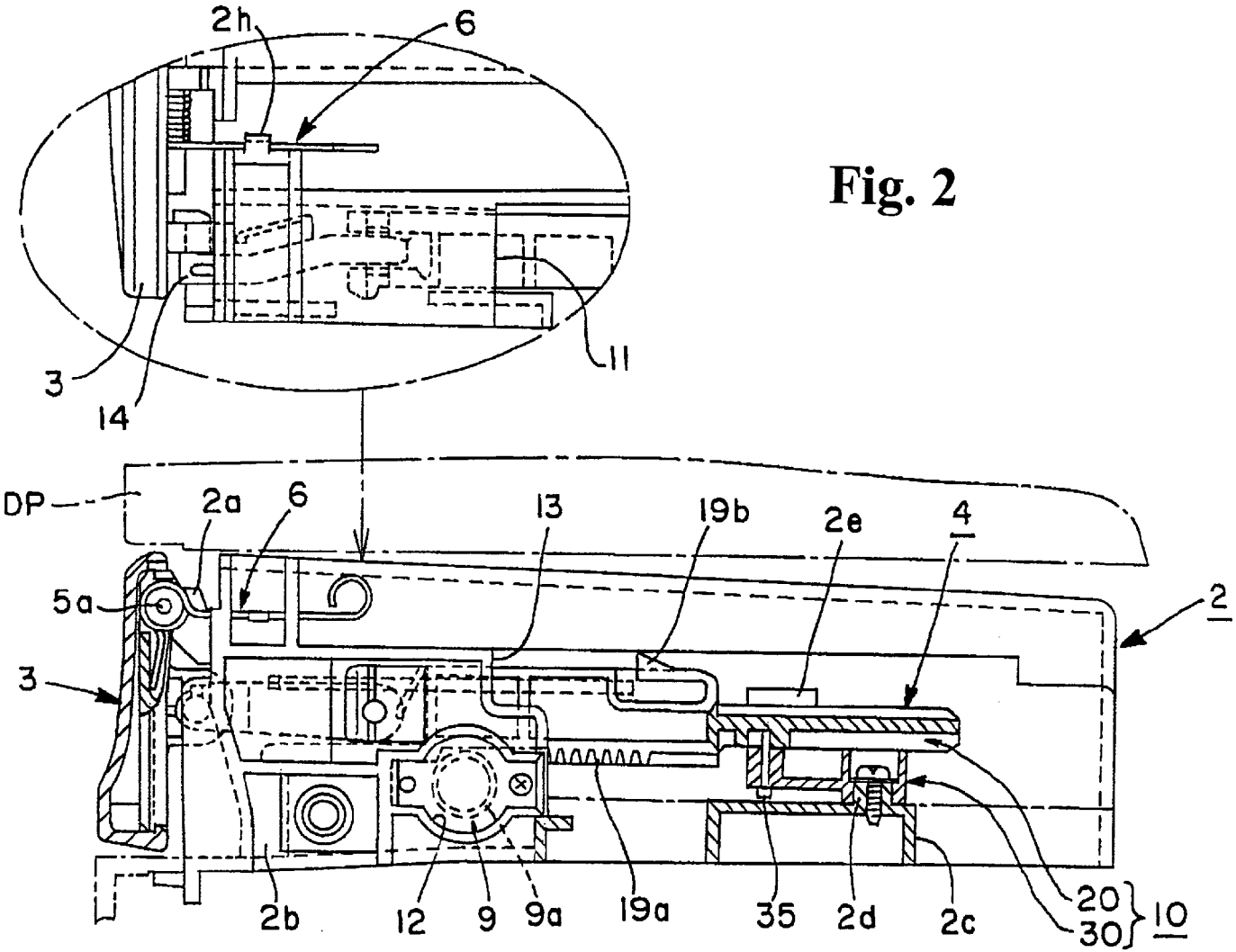
FIG. 2 is a partially cut generalized structural drawing showing the storage apparatus of FIG. 1 when the lid is closed.
Figure 3:
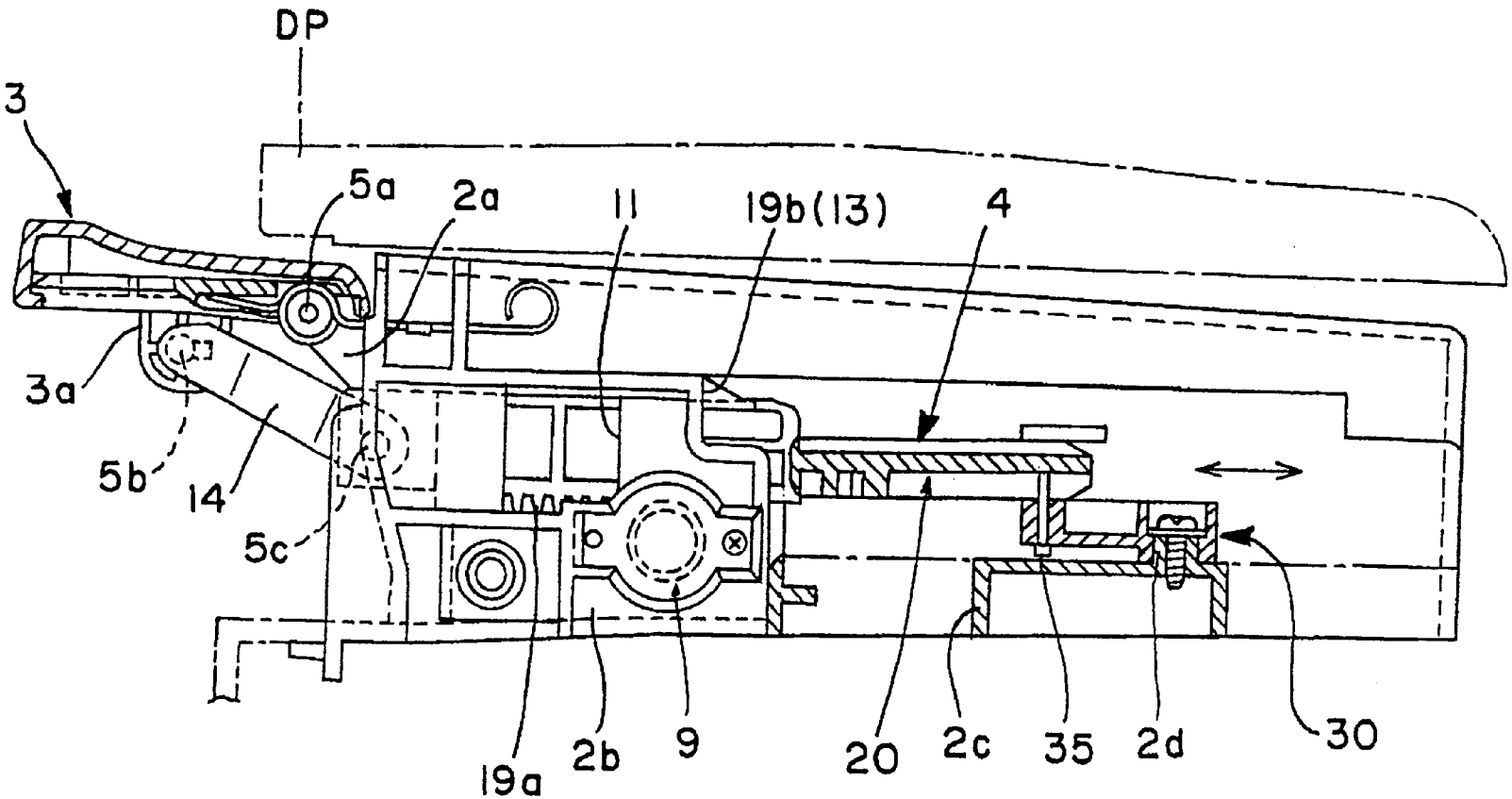
FIG. 3 is a partially cut generalized structural drawing showing the storage apparatus of FIG. 1 when the lid is opened.
Figure 4A:
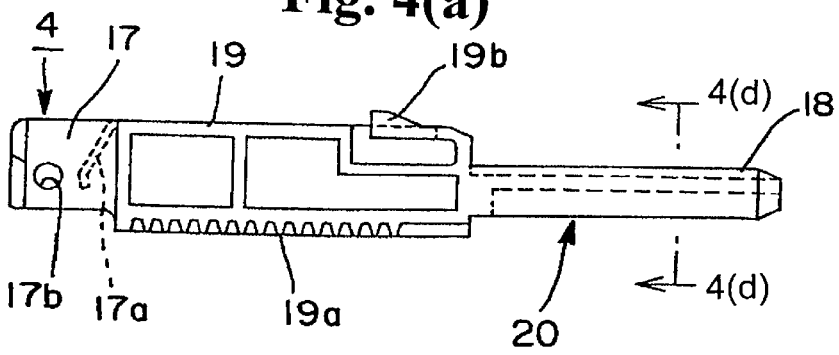
FIGS. 4(*a*) through 4(*e*) is a detailed drawing of the slider which is a main member of the locking apparatus of the present invention.
Figure 4B:
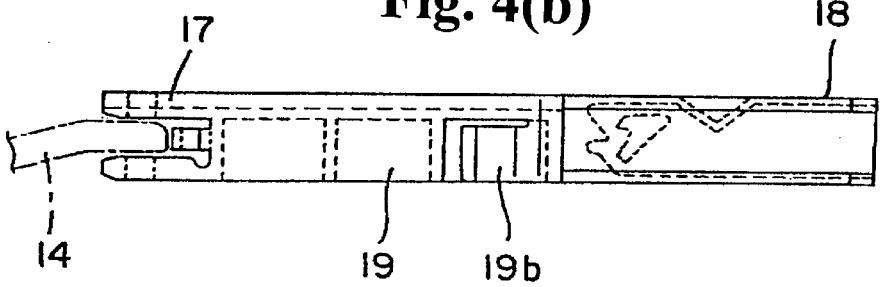
Figure 4C:
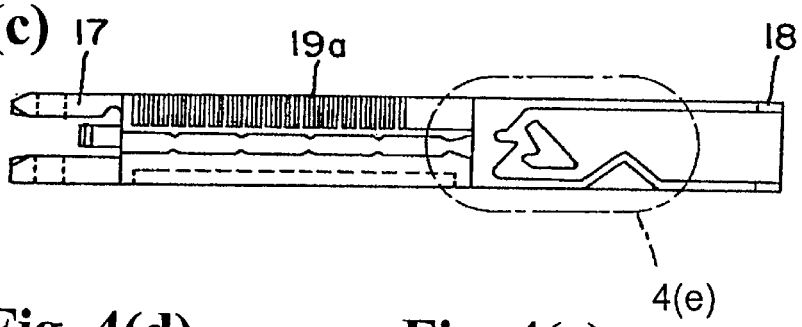
Figure 4D:
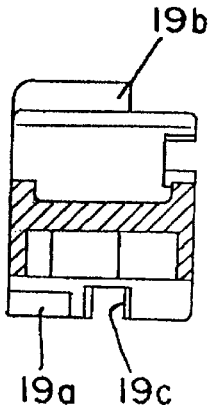
Figure 4E:
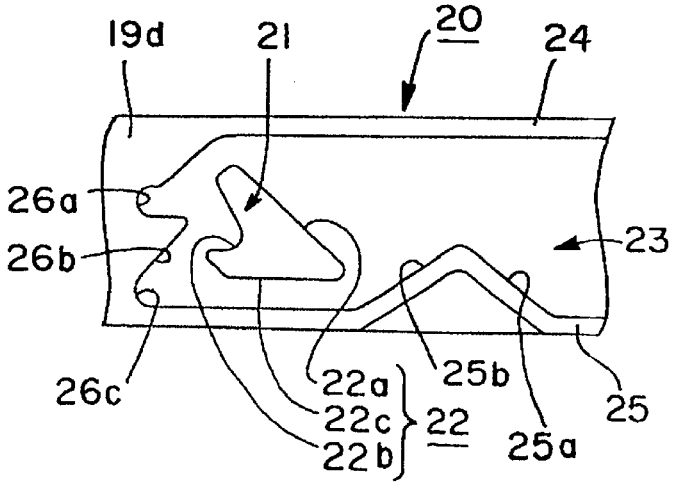
Figure 8:
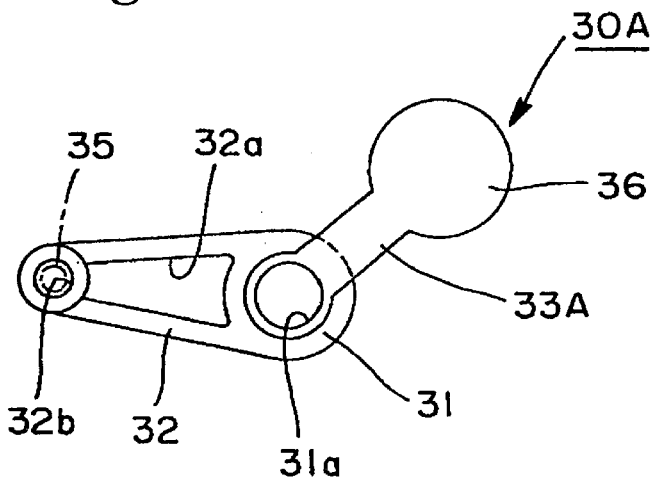
FIG. 8 is a drawing showing another example of the above swivel body.
Figure 9A:
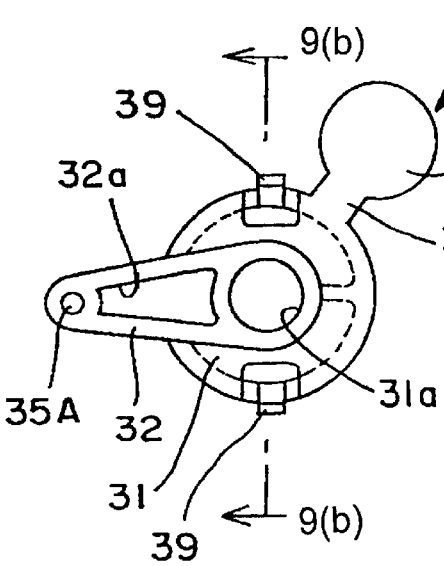
FIGS. 9(*a*) and 9(*b*) are drawings showing yet another example of the above swivel body.
Figure 9B:
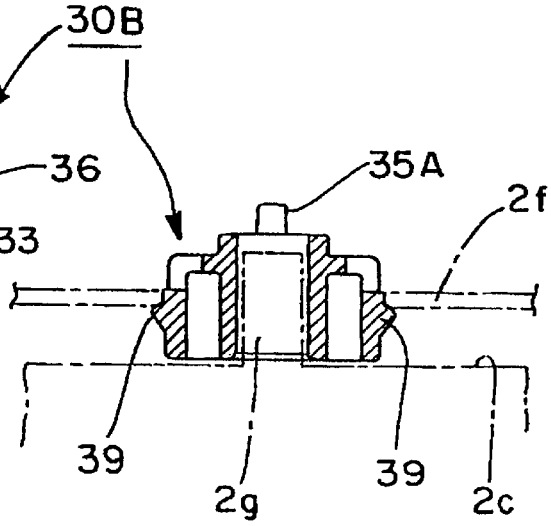
Figure 10A:
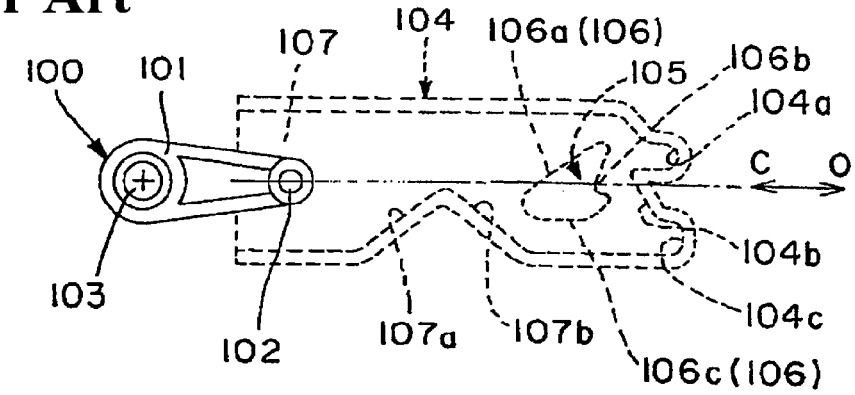
Fig. 10(a) Prior Art
FIGS. 10(*a*) through 10(*c*) is a drawing of a locking apparatus in the prior art.
Figure 10B:
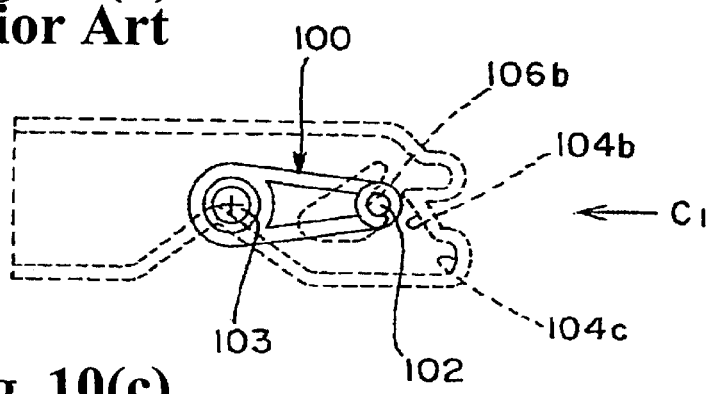
Fig. 10(b) Prior Art
Figure 10C:
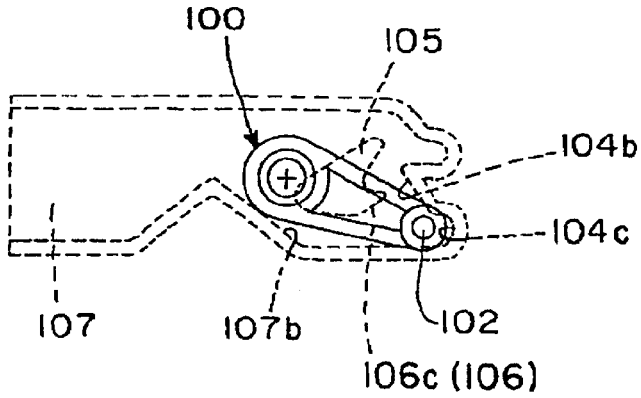
Fig. 10(c) Prior Art

FIG. 1 through FIG. 3 shows a storage apparatus that incorporates a locking apparatus according to the present invention. FIG. 4(*a*) through FIG. 5(*c*) shows the constituent members of the push—push engagement mechanism. FIGS. 6(*a*) and 6(*b*) show the relationship between the slider and the swivel body when the push—push engagement mechanism is engaged, and FIGS. 7(*a*) to 7(*c*) show the operation of the push—push engagement mechanism. FIG. 8 through FIG. 9(*b*) shows modified examples of the swivel body. In the explanation below, first, the storage apparatus that uses the locking apparatus of the present invention is explained, and then the locking apparatus is explained in detail, so that the operating characteristics and advantages are made clear.

FIG. 1 is a generalized external view of the storage apparatus applying the locking apparatus of the present invention; FIG. 2 is a partially exploded typical structural drawing showing the essential components when the push—push engagement mechanism is engaged; and FIG. 3 is a partially cut typical structural drawing showing the essential components when the push—push engagement mechanism is released.

As for the storage apparatus 1 of the embodiment, a housing 2 has an opening, and a lid 3 opens and closes the opening. The opening and closing operation of the lid 3 is accomplished by using a push—push engagement mechanism (the locking apparatus of the present invention) comprising a slider 4 that moves in the forward and backward directions of the housing 2, forcing means 6 that forces the slider 4 toward the front of the housing 2, damping means 9 that adjusts the speed of the slider 4, a cam part 20, and a swivel body 30. This storage apparatus 1 is designed to be installed in the dashboard DP (its recessed place) in the vehicle compartment, but it may be other than the dashboard DP, for example it can also be incorporated into a part of an instrument panel or center console and so on.

The housing 2 forms a container shape having an opening at the front side. In the present invention, the member placement part including the lid 3, the slider 4, the forcing means 6, the damping means 9, and the swivel body 30 constitutes essential parts of the invention, while the internal structure and the external appearances of the housing 2 are optional. As shown in FIG. 2, the lid attachment part is located near the opening of the housing 2 and includes a pair of attachment pieces 2*a* that project forward the upper two sides. The lid 3 is attached at its inner parts to the two attachment pieces 2*a* via pivots 5*a*, and it is pivotally supported to be capable of rotation between a closed position (FIG. 2) and an opened position (FIG. 3). The member placement part is provided along the external side surface of the housing 2, and it comprises a front holding part 2*b* and a rear holding part 2*c*. The front holding part 2*b* is attached roughly between the front and the middle of the housing 2, and includes the end of the forcing means 6 and the slider 4 and damping means 9. The rear holding part 2*c* positioned a little to the rear of the front holding part 2*b* has the swivel body 30.

The front holding part 2*b* has a tab part 2*h* provided on the front upper side, a guide hole 11 that penetrates from front to back, a depressed part 12 provided on the outer side surface partitioned by that guide hole 11, and an engagement surface 13 provided on the rear side of the guide hole part 11. The tab part 2*h* defines the position of one end of the forcing means 6. The forcing means 6, which is attached to the inner surface of the lid at one end and is positioned by the tab part at the other end, is a spring member supported around the pivot 5*a*, and always pushes the lid 3 toward the open position. On the back surface of the lid 3, a connecting rib 3*a* that connects the slider 4 is placed to protrude outward as in FIG. 3.

The guide hole 11 roughly corresponds to the vertical section of the slider 4 which is placed inside, and a part of the slider 4 is exposed. The front side of the slider 4 and a connecting rib 3*a* are connected via a link piece 14. As shown in FIG. 3, one end of the link piece 14 is connected to the rib 3*a* by a shaft 5*b* (in the embodiment, the shaft part is integrally formed with the link piece 14), and the other end thereof is connected to the front side of the slider 4 via a shaft part 5*c*, so that both can rotate freely. When the lid 3 is opened, the slider 4 is moved up to the most forward position (this position is restricted by the engagement surface 13) via the link piece 14. When the lid 3 is closed, the slider 4 is moved up to the most rear position (this position is the end point of rotation of the lid 3, and is engaged by the cam part 20 and the swivel body 30) via the link piece 14.

The depressed part 12 has an open part that penetrates into the guide hole part 11, and the damping means 9 is provided at a predetermined position. The damping means 9 consists of an oil damper, and the like, and it has a gear 9*a* that is installed on the side of the rotating shaft that receives the resistance of the operating oil. The gear 9*a* engages rack teeth 19*a* of the slider 4. By this engagement, the damping means 9 can regularly be operatable when the slider 4 is moved forward and backward.

The rear holding part 2*c* is a place that incorporates the swivel body 30 which constitutes the locking apparatus of the present invention. In this example, the upper surface is horizontal, and it has a cylindrical boss part 2*d* that pivotally supports the swivel body 30 to rotate freely. Minimum function of the rear holding part 2*c*, however, is to hold the swivel body 30 in a stable state, and to be located immediately beneath the cam part 20 of the slider 4 when the lid 3 is in the closed position. Above the rear holding part 2*c*, there is provided a guide wall part 2*e* that projects from the side surface of the housing 2 and guides by contacting with the upper surface of the rear side of the slider 4.

Figure 5A:
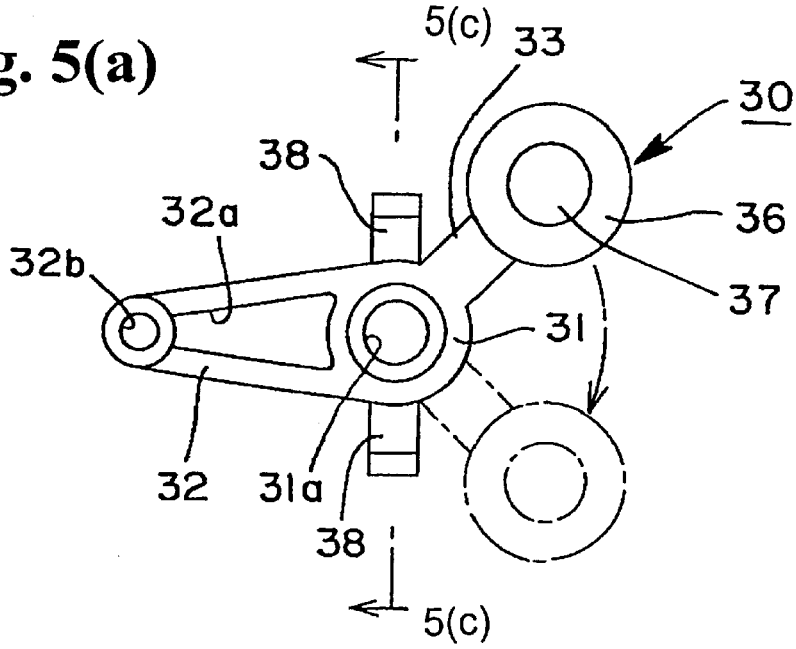
FIGS. 5(*a*) through 5(*c*) is a detailed drawing of the swivel body which is a main member of the locking apparatus of the present invention.
Figure 5B:
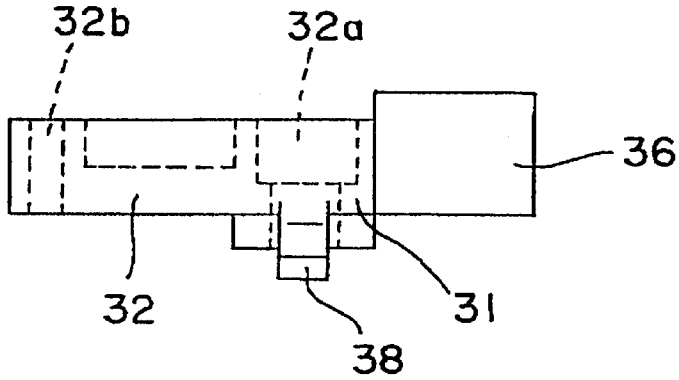
Figure 5C:
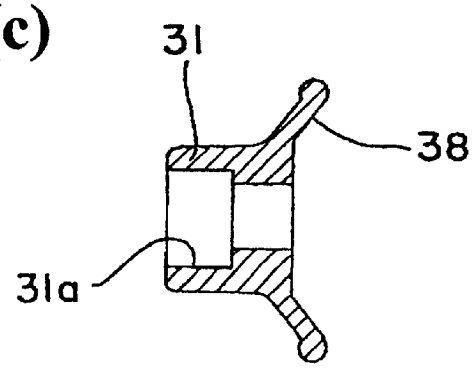
Figure 6A:
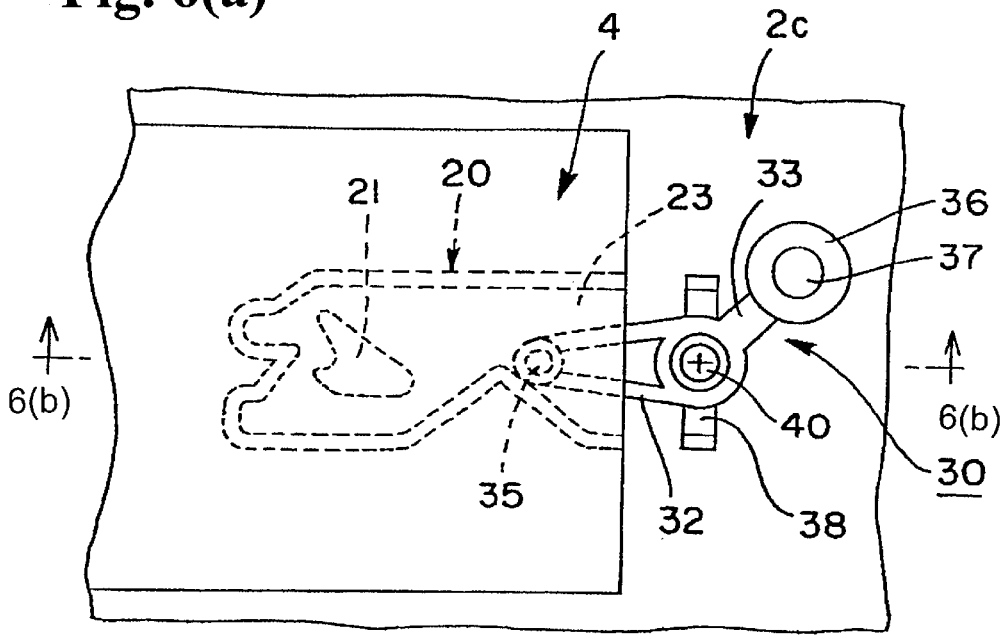
FIGS. 6(*a*) and 6(*b*) are drawings showing the relation between the above slider and swivel body.
Figure 6B:
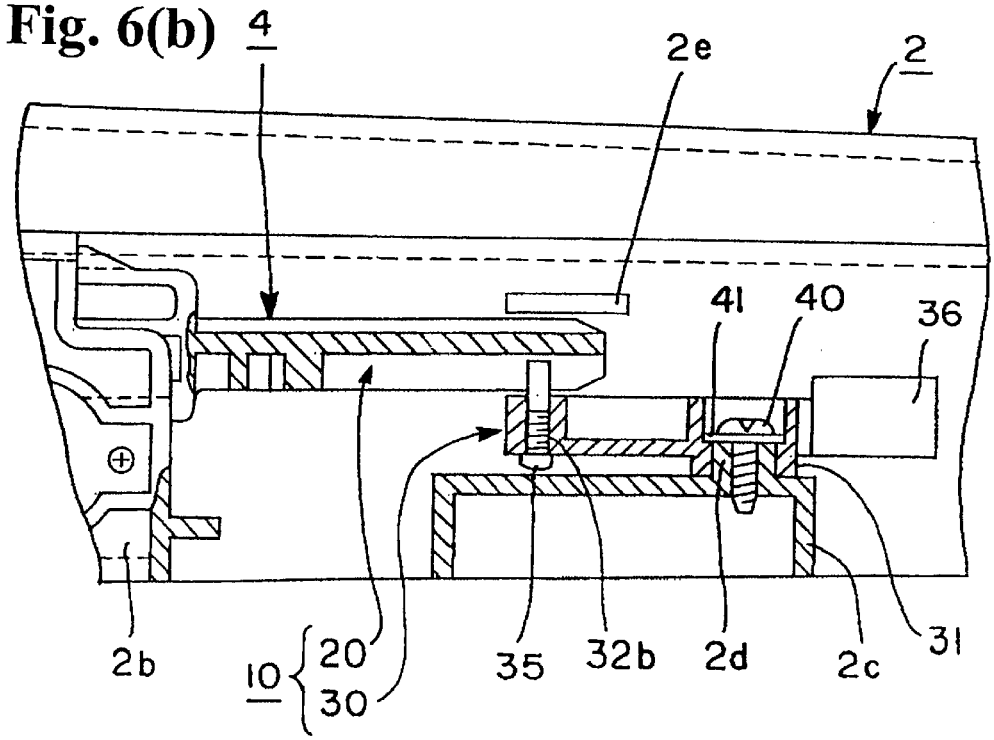

In FIG. 4(*a*) to FIG. 5(*c*), FIG. 4(*a*) is a side view, FIG. 4(*b*) is a top view, FIG. 4(*c*) is a bottom view, FIG. 4(*d*) is an enlarged view taken along line 4(*d*)—4(*d*) in FIG. 4(*a*), and FIG. 4(*e*) is an enlarged view of part 4(*e*) in FIG. 4(*c*). FIG. 5(*a*) is a top view, FIG. 5(*b*) is a side view, and FIG. 5(*c*) is a sectional view taken along line 5(*c*)—5(*c*) in FIG. 5(*a*). The locking apparatus 10 is an example in which the cam part 20 is provided on the slider 4, and the swivel body 30 is attached to the rear holding part 2*c*. However, as for the push—push engagement mechanism, the swivel body 30 can be attached to the slider 4, and the cam part 20 can be provided in an analogous place on the holding part 2*c*.

The slider 4 which has the cam part 20 is explained here. The slider 4 forms a long and slender rod shape, and functionally, it is divided into a front side 17, a rear side 18, and a middle part 19. The front side 17 has two projection parts with holes 17*b* that pierce the two parts on the same axis, and an elastic piece 17*a* that is provided between the two parts and projects diagonally downward. The attachment hole 17*b* is a hole for connecting the rear side of the link piece 14 described above via a shaft part 5*c*. The elastic piece 17*a* presses against the end part of the link piece and is linked to the link piece 14 to eliminate a gap. The middle part 19 has rack teeth 19*a* on one side of the part, an engagement claw 19*b* that meets the engagement end surface part 13 noted above, and a guide indentation 19*c* that is provided on the bottom surface and extends from front to back. The rack teeth 19*a* engage the gear 9*a* of the damping means 9 and enables the controlled forward and backward movements of the slider 4. The engagement claw 19*b* is placed against the engagement end surface part 13, and it controls the most forward position of the slider 4. The guide indentation 19*c* engages a projected part (not shown) that is provided on the guide hole part 11 noted above, and it makes the smooth sliding of the slider 4. The rear side has the cam part 20 on the bottom surface side.

The cam part 20, as in FIG. 4(*c*), comprises a heart-shaped cam groove 22 that is formed by a raised cam part (a heart-shaped raised cam part) 21, and a guide groove 23 that continues with the cam groove 22. As for the cam groove 22 and the guide groove 23, the two sides are partitioned by control wall parts 24 and 25 and the front side by the rear part 19*d* of the center part 19, and the rear end is continuous with the outside. The cam groove 22 is formed along the outer periphery of the cam part 21, and it consists of an engagement guide cam groove 22*a*, an engagement groove 22*b*, and a releasing guide cam groove 22*c*. The engagement guide cam groove 22*a* is a sloping groove that corresponds to one side of the heart shape and extends diagonally on the front side (rear part 19*d*) from the control wall part 25 between control wall parts 24, 25. The engagement groove 22*b* is positioned in roughly the center of the upper side part of the heart shape, and collapses inward between the part sloping from the apex of the guide cam groove 22*a* and the apex of the guide cam groove 22*c*.

The control wall part 25 has a place between the cam groove 22 and the guide groove 23 bent into a mountain shape up to near halfway between the left and right of the control wall part 25, and the entrance side of the guide groove 23 is formed as the engagement guide cam surface 25*a* and the cam groove 22 side as the releasing cam surface 25*b*. On the end surface side of the rear part 19*d*, that is, the front of the cam part 21, there are provided an engaging stopper cam surface 26*a*, a sloping guide cam surface 26*b*, and a releasing stopper cam surface 26*c*. These are substantially the same as in the past.

This swivel body 30 is a molded resin product comprising an attachment part 31, a first arm 32, and a second arm 33.

The attachment part 31 has a pivot hole 31*a* that is provided roughly in the center of both arms 32, 33, and a pair of elastic wing pieces 38 that is provided on both sides roughly intersecting the first arm 32 and supports the swiveling or sliding ability of the swivel body 30. The first arm 32 forms a roughly triangular leaf shape. On the upper side, there is provided a cutout cavity for making it lightweight, and on the tip, there is provided an installation hole 32*b*.

The second arm 33 has a spindle 36 that serves as the main component of the balancer on the free end side. The second arm 33 is formed integrally with the attachment part 31, and the spindle 36 is formed on the tip. The spindle 36 has a metal member 37 inserted into a molded resin part, and it is heavier than the first arm 32 by a specified value. The angle with the first arm 32 is set to 130–140 degrees. This angle, as shown by the projected line in FIG. 5(*a*), determines the rotational direction of the swivel body 30 centered on the pivot hole 32*a*. It is designed based on the load of the spindle 36 or the total weight of the second arm 32, such that once the trace pin 35 has escaped from the position in FIG. 7(*b*), the swivel body 30 exclusively swivels toward the direction of the solid line in FIG. 7(*c*), as the optimum for balance adjustment.

The above swivel body 30 is fixed with the trace pin 35 in the installation hole 32*b* as in FIG. 6(*b*). The trace pin 35 is a metallic pin, it is pressed upward from the bottom side into the installation hole 32*b* and it is fixed via adhesive, and the like. The tip is projected outward above the attachment part 31. The swivel body 30 is attached to swivel or slide freely above the rear holding part 2*c*. In this case, the swivel body 30 receives the boss part 2*d* in the pivot hole 31*a* as in same drawing, and it is attached by screwing a screw 40 to the boss part 2*d* via a washer 41 from the side of the pivot hole 31*a*.

The main operation of the locking apparatus 10 is outlined together with the lid opening and closing operation of the storage apparatus 1. FIG. 3 shows the state in which the lid 3 is fully opened up to the top horizontal position by the force of the forcing means 6, and small objects can be put into or taken out from the housing 2 through the front open part of the housing 2. In this opened state, the moving body 4 is moved to the most forward position, and the engagement claw 19*b* meets the engagement end surface part 13. The trace pin 35 is at the entrance side of the guide groove 17 as shown in FIG. 7(*a*).

In closing the lid 3, when the open end of the lid 3 is pushed downward opposite to the force of the forcing means 6, the lid 3 rotates downward with the pivots 5*a* as the pivot point, and the movement of that lid 3 is transmitted to the slider 4 via the link piece 14. The slider moves backward in FIG. 3 accompanying the movement toward the closed position of the lid 3 at a speed damped by the damping means 9. When the slider 4 moves backward, the pin 35 first meets the engagement guide cam surface 25*a*. Doing thus, the swivel body 30 rotates counter-clockwise, then meets the engagement guide cam surface 22*a* followed by colliding with the engaging stopper cam surface 26*a*. When the trace pin 35 meets the stopper cam surface 26*a*, the lid 3 passes the proper closed position and is moved a little toward the open part of the housing 2. When the pushing force on the lid 3 is released, it is returned to the proper closed position by the force of the forcing means 6. This is consistent with when the trace pin 35 moves to the engagement groove 22*b* from the stopper cam surface 26*a* as in FIG. 7(*b*), and it has become to the engaged state by the push operation. That is, the push operation is completed, and the lid 3 is in the closed position in FIG. 2.

Figure 7A:
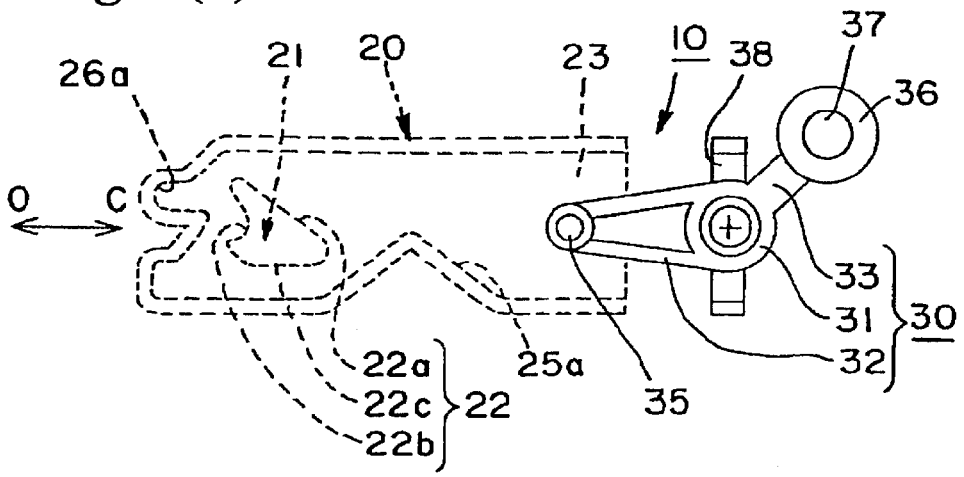
FIGS. 7(*a*) through 7(*c*) is a an operation drawing showing the operation of the above locking apparatus.
Figure 7B:
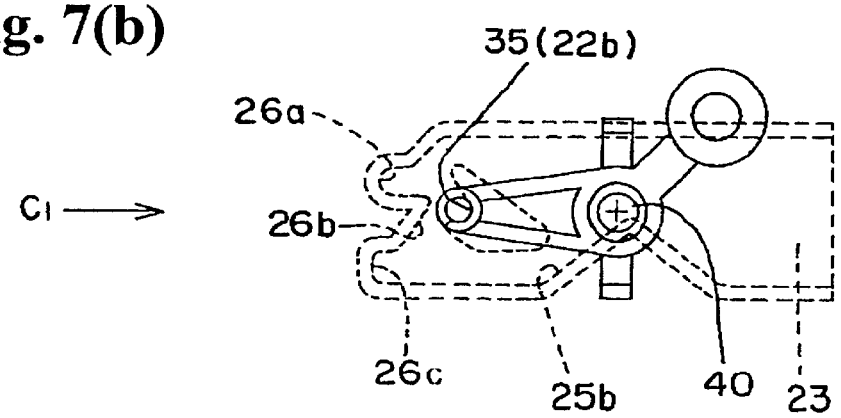
Figure 7C:
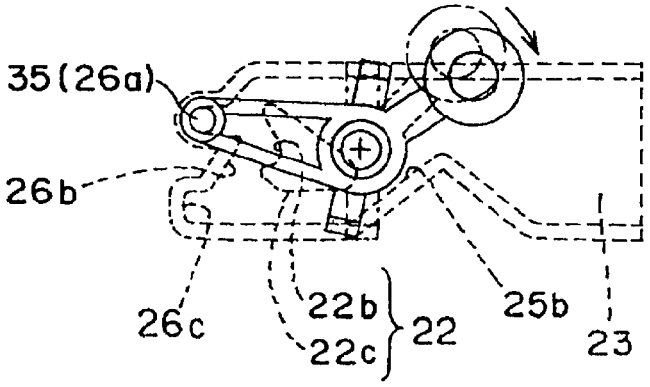

In case of opening the lid 3 again, when the lid 3 is pushed (the arrow C1 in FIG. 7(*b*)), the trace pin 35 meets the sloping guide cam surface 26*b*, and is led up to the releasing stopper cam surface 26*c* accompanying the rotation of the swivel body 30. When the pushing force is released, the lid 3 is returned forward. This slider 4 moves forward in synchronization with this while being damped. At the same time, the trace pin 35 is returned to the state in FIG. 7(*a*) meeting the releasing guide cam surface 25*b* along the way. That is, the subsequent push operation is completed, and the lid 3 is placed in the original open position. These steps are substantially the same as in the past.

The operating characteristic of the present invention resides in that when the lid 3 is in the closed position and the storage apparatus 1 has received a sudden load that is forward, namely, the same as the push release operation, due to abrupt stopping of the vehicle or excessive impact. In such a circumstance, the swivel body 30 works with the balance adjustment function using the second arm 33 with the spindle 36. Upon receiving the load, the swivel body 30 tries to rotate or roll around the screw 40. The rotational direction is balanced to be the direction of the arrow in FIG. 7(*c*), by the presence of the second arm 33 with the spindle 36. As a result, even when the trace pin 35 disengages from the engagement groove 22*b*, that direction is always controlled toward the engaging stopper cam surface 26*a*. Accordingly, when the load no longer exists, the trace pin 35 comes to be engaged with the original engagement groove 22*b* from the engaging stopper cam surface 26*b* by the same movement as the movement from FIG. 7(*a*) to FIG. 7(*b*). After that, it returns to the normal operation.

FIG. 8 and FIG. 9 are two modified examples of the above swivel body 30. In each modified example, the parts that are the same or similar are assigned by the same symbols, and only the points of modification are explained. The swivel body 30A is an example when the second arm 33A is formed separately. That is, this second arm 33A consists of a metallic member with a weight 36 formed integrally on the side of the tip. Also, with respect to the swivel body 30A, it is designed to be integrated by engaging the base side of the second arm 33A in a depressed place provided on one part of the attachment part 31. This design has an advantage because it is difficult to assure the load on the side of the second arm 33A (the weight relative to the side of the first arm 32) due to a small size of the swivel body 30A. This construction makes the load design of the second arm 33A easier, and makes it possible to assuredly obtain the intended balance adjustment by controlling the total dimensions of the second arm part 33A.

The swivel body 30B in FIGS. 9(*a*) and 9(*b*) is an example having a modified structure incorporating into the side of the housing 2 or the moving body. That is, this attachment part 31 has a pair of elastic engagement parts 39 on the outer periphery, and those elastic engagement parts 39 are incorporated into an attachment part 2*f* (an attachment hole provided at this location) by insertion method. In this case, the shape of the above rear holding part 2*c* is modified, and the attachment part 2*f* and the pivot 2*g* are attached. It is possible for the parts to be attached and rotate freely without using the screw 40 and the like. In this example, the trace pin 35A is formed integrally on the swivel body 30B, and the number of components is further reduced.

Thus, the present invention, as long as the technical elements described in the claims are provided, is capable of various modifications based on the above fundamental example. Of course, the moving body 4 is not limited to the slider of the example, and it also may be a storage tray or lid that is moved with respect to the housing, furthermore a slider member, such as in Japanese Patent Application No. H11-163992, and other things.

As explained above, the locking apparatus of the present invention eliminates sudden release of the engaged state due to unanticipated load by sudden stopping while driving or by collision, and the like, or when excessive vibration is directly or indirectly received. Also the locking apparatus of the present invention improves the operation and quality of the products, and can expand the application thereof.

Also, the storage apparatus for vehicle to which the present invention is applied can improve the safety and the reliability of the apparatus over the prior art by eliminating unanticipated engagement release, that is, erroneous operation of the moving body, as well as unanticipated pop-up.

While the invention has been explained with reference to the specific embodiments of the invention, the explanation is illustrated and the invention is limited only by the appended claims.

What is claimed is:

1. A locking apparatus for locking a moving body to a housing against an urging force applied to the moving body, comprising:

a cam provided on one of the moving body and the housing, and having an engagement groove and a releasing groove, and a swivel body including a rotatable attachment part rotatably attached to the other of the moving body and the housing, a first arm connected to the attachment part and having a trace pin projecting outwardly therefrom and moving along the grooves, and a second arm connected to the attachment part at an angle of at least 90 degrees relative to the first arm to form a balancer for balancing the trace pin so that upon receiving a sudden load when the trace pin is in an engaging condition with the engagement groove, the trace pin is prevented from moving from the engagement groove to the releasing groove to thereby lock the moving body.

2. A locking apparatus according to claim 1, wherein said cam includes a heart-shaped cam groove having the engagement groove, and an engaging stopper cam surface adjacent the releasing groove at a side opposite to the engagement groove, said trace pin moving form the engagement groove to the releasing groove by a push—push movement therebetween.

3. A locking apparatus for locking a moving body to a housing against an urging force applied to the moving body, comprising:

a cam provided on one of the moving body and the housing, and having an engagement groove and a releasing groove, and a swivel body provided on the other of the moving body and the housing and being made of a molded resin product, said swivel body having an arm, a trace pin attached to one side of the arm and moving along the grooves, and a balancer fixed to the other side of the arm for balancing the trace pin, said balancer having a weight for returning the trace pin to the engagement groove in association with the urging force after receiving a sudden load when the trace pin is in an engaging condition with the engagement groove so that upon receiving the sudden load when the trace pin is in the engaging condition with the engagement groove, the trace pin is prevented from moving from the engagement groove to the releasing groove to thereby lock the moving body.

4. A locking apparatus according to claim 3, wherein said swivel body includes a first arm to which the trace pin is fixed, and a second arm attached to the first arm to incline thereto, said second arm forming the balancer.

5. A storage apparatus for a vehicle, comprising:

a housing attached inside the vehicle and having an opening, a lid attached to the housing for covering the opening of the housing, a moving body having one end connected to the lid to move along a side of the housing, urging means attached to the moving body for urging the moving body toward a lid open direction, and a locking apparatus including a cam provided on one of the moving body and the housing and having an engagement groove and a releasing groove, and a swivel body having a rotatable attachment part rotatably attached to the other of the moving body and the housing, a first arm connected to the attachment part and having a trace pin projecting outwardly therefrom and moving along the grooves, and a second arm connected to the attachment part at an angle of at least 90 degrees relative to the first arm to form a balancer for balancing the trace pin so that upon receiving a sudden load when the trace pin is in an engaging condition with the engagement groove, the trace pin is prevented from moving from the engagement groove to the releasing groove to thereby lock the moving body.

6. A storage apparatus according to claim 5, wherein said balancer comprises a weight for returning the trace pin to the engagement groove in association with the urging force after receiving the sudden load when the trace pin is in the engaging condition.

* * * * *